US005908153A

United States Patent [19]

Greer et al.

[11] Patent Number: 5,908,153

[45] Date of Patent: Jun. 1, 1999

[54] CONTAINER MADE FROM SINGLE FOLDABLE PANEL

[76] Inventors: Jerry A. Greer, 254 Corona Ave., Long Beach, Calif. 90803; Steve T. Josephson, 2628 E, 54th, Huntington Park, Calif. 90255

[21] Appl. No.: 08/803,680

[22] Filed: Feb. 21, 1997

[51] Int. Cl.[6] ..... B65D 5/72

[52] U.S. Cl. ..... 229/122.2; 229/121; 229/198.2; 229/163

[58] Field of Search ..... 229/122.2, 121, 229/162, 198.2, 163; 206/494; 221/281

[56] References Cited

U.S. PATENT DOCUMENTS

| | | | |
|---|---|---|---|
| 1,361,882 | 12/1920 | List | 229/122.2 X |
| 1,767,734 | 6/1930 | Brown | 229/121 |
| 2,068,763 | 1/1937 | Powell . | |
| 2,287,648 | 6/1942 | Sunderhauf et al. | 229/163 X |
| 2,297,571 | 9/1942 | Lowey | 229/120.18 |
| 2,320,665 | 6/1943 | Shearer | 229/162 X |
| 2,714,446 | 8/1955 | Gillam . | |
| 2,894,674 | 7/1959 | Wagaman | 229/162 X |
| 2,902,200 | 9/1959 | Manners | 229/122.2 |
| 3,258,156 | 6/1966 | Smith | 206/494 X |
| 3,313,468 | 4/1967 | Ross | 229/163 X |
| 3,528,598 | 9/1970 | Lock | 229/121 |
| 3,701,181 | 10/1972 | Lock . | |
| 4,361,265 | 11/1982 | Benham | 229/162 X |
| 4,708,284 | 11/1987 | Sutherland et al. | 229/198.2 |
| 4,711,389 | 12/1987 | Alba et al. . | |
| 4,846,394 | 7/1989 | Swanson . | |
| 5,180,100 | 1/1993 | Shimizu | 229/198.2 |
| 5,240,176 | 8/1993 | Akers . | |
| 5,356,022 | 10/1994 | Tipps . | |
| 5,398,870 | 3/1995 | Bienaime | 229/198.2 |
| 5,518,168 | 5/1996 | Mayer . | |

*Primary Examiner*—Gary E. Elkins
*Assistant Examiner*—Tri M. Mai
*Attorney, Agent, or Firm*—Longacre & White

[57] ABSTRACT

A multipurpose panel structure formed of a relatively thin resilient type material adaptable for use as a container device, the panel structure comprising a relatively flat one-piece wall member having a cooperatively engageable interlocking arrangement associated therewith enabling the wall member to be formed into substantially closed-wall structure capable of standing on end to form a container device, the cooperatively engageable interlocking arrangement providing an easily assembled yet stable container which may be shipped in its flat condition and later assembled without the need for special tools or equipment. The container assembly may take various shapes adaptable for holding a wide variety of materials including tissue paper.

12 Claims, 1 Drawing Sheet

CONTAINER MADE FROM SINGLE FOLDABLE PANEL

BACKGROUND OF THE INVENTION a) Field of the Invention

The present invention relates generally to a re-usable container assembly for holding a variety of materials that is easy to manufacture, transport and assembly. The container of the present invention is particular suited to hold tissue paper. The tissue container of this invention has a unique configuration which enhances ease of assembly because the container is formed from a single foldable panel.

b) Description of Related Art

In an office, store, merchandising or any other environment, many different types of containers are abundantly used for collecting and storing promotional articles. Typically, known prior art container devices are of a totally rigid, noncollapsible construction and, importantly, few of the known devices are designed to be transported in a disassembled state for ease of portability, while providing a design which is easy to assemble on-site. A totally rigid construction makes the known devices expensive to manufacture as well as bulky, awkward and difficult to transport from one location to another. There therefore exists a need for an inexpensive container assembly which can be easily and conveniently employed in a wide variety of environments, both indoors and outdoors, which container assembly can be stored and shipped in a compact, flat package and can be easily and readily assembled and disassembled by a single non-skilled person without tools and without external fasteners or other components.

Several prior art containers having been proposed which are formed from a foldable, resilient member. See U.S. Pat. No. 5,372,269 to Sutton et al. and U.S. Pat. No. 5,356,022 to Tipps. These prior art devices however are awkward to assemble, overly expensive to manufacture, lack the stability necessary for a wide variety of applications, and are not suitable for use as a tissue holder.

SUMMARY OF THE INVENTION

The present invention teaches the construction and operation of a multipurpose container assembly wherein the container consists of a uniquely-shaped, Foldable blank that can be stored, packaged and transported in substantially flat condition. A rectangular structure is formed from this single flat body panel that is made of a material that causes the panel to be somewhat resilient as well as somewhat biased towards its flat condition. When folded into a container, this rectangular structure has smooth contours and edges that are not only safe and pliable, but also pleasant to the eye and easy to use.

In its preferred embodiment, the present container assembly is comprised primarily of a single flat sheet of a resilient type material which is shaped and connected together to form a rectangular closed-wall panel structure, that can be uniquely formed into a tissue box shape. The blank can also be imprinted, embossed or otherwise decorated with indicia such as a company logo, promotional material, or other data. When not used, it is envisioned that the container assembly can be returned to its original flat condition. The foldable blank forming the present container can be packaged, stored and furnished in substantially flat form and they can be easily assembled and disassembled without tools or other means.

In its folded state, cooperatively engageable interlocking means are associated with each other at interlocking sides and edges of the body panel; the interlocking means enabling the respective end portions of the body panel to be locked together at adjacent side edges to form a novel closed-wall shape or similar arrangement. The design of the cooperatively engageable means is such that, when the body panel is in its closed wall form and such means are engaged, the resilience of the body panel retains the body panel in the preferred shape. The interlocking members are designed to securely Lock together to maintain the structure's assembled state.

With this invention, the foldable body panel can be imprinted, embossed, engraved, etched or otherwise decorated with indicia and can be easily and simultaneously used as a sign to promote the sale of goods and/or services in a commercial setting to promote an activity or event, or to convey any particular message in an office or other environment. Because the foldable blank of this invention is easily manufactured and shipped, this enables a user to imprint a company logo, advertising promotional material, or any other message on the body panel and to display the same when the present device is utilized as a promotional or waste container. Since the body panel is made of a lightweight, preferably resilient or flexible, material as will be hereinafter explained, it can be easily manufactured, transported and assembled for use as a container assembly. The present assembly affords a user a simple arrangement to assemble, particularly, in a commercial environment where one is promoting and merchandising goods and/or services for short period of time with the constant need to replace one advertisement with another in a simple and inexpensive manner.

When used as a tissue holder, tissue is easy replaced by means of a trap-door arrangement on the bottom portion of the container.

These and other objects and advantages of the present invention will become apparent to those skilled in the art after considering the following detailed specification in conjunction with the accompanying drawings.

DETAILED DESCRIPTION OF THE INVENTION

Figure 2:
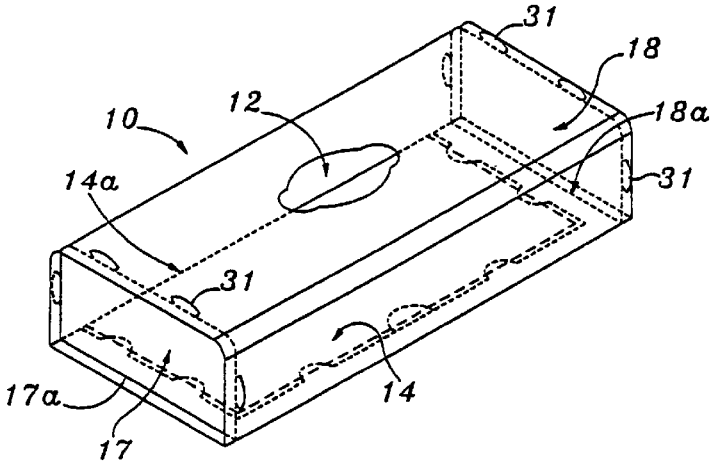
FIG. 2 is a perspective view of one embodiment of the present multipurpose container assembly constructed according to the teachings of the present invention.

Referring to the drawings, FIG. 2 identifies one embodiment of a multipurpose container assembly constructed according to the teachings of the present invention. The container assembly 10 is formed as a tissue holder and includes an uninterrupted body panel or wall member 20, the body panel 20 being formable into a closed-wall structure capable of standing on end to form a rectangular box 10 as shown in FIG. 2. The closed-wall structure of FIG. 2 comprises an opening 12 at a top side. The bottom side is formed with a door 14 that is retained in a closed state by tabs 16 disposed about the perimeter of the opening in the bottom of the container shown in FIG. 2. When the container 10 is formed from a single folded panel 20, the door 14 is resiliently biased against the tabs 16 to maintain the door 14 in a closed state.

In the preferred embodiment, the container 10 is filed with tissue paper by opening the door 14 and arranging the tissue paper properly within the container 10. Individual tissues are selected from the container 10 via the opening 12.

Figure 1:
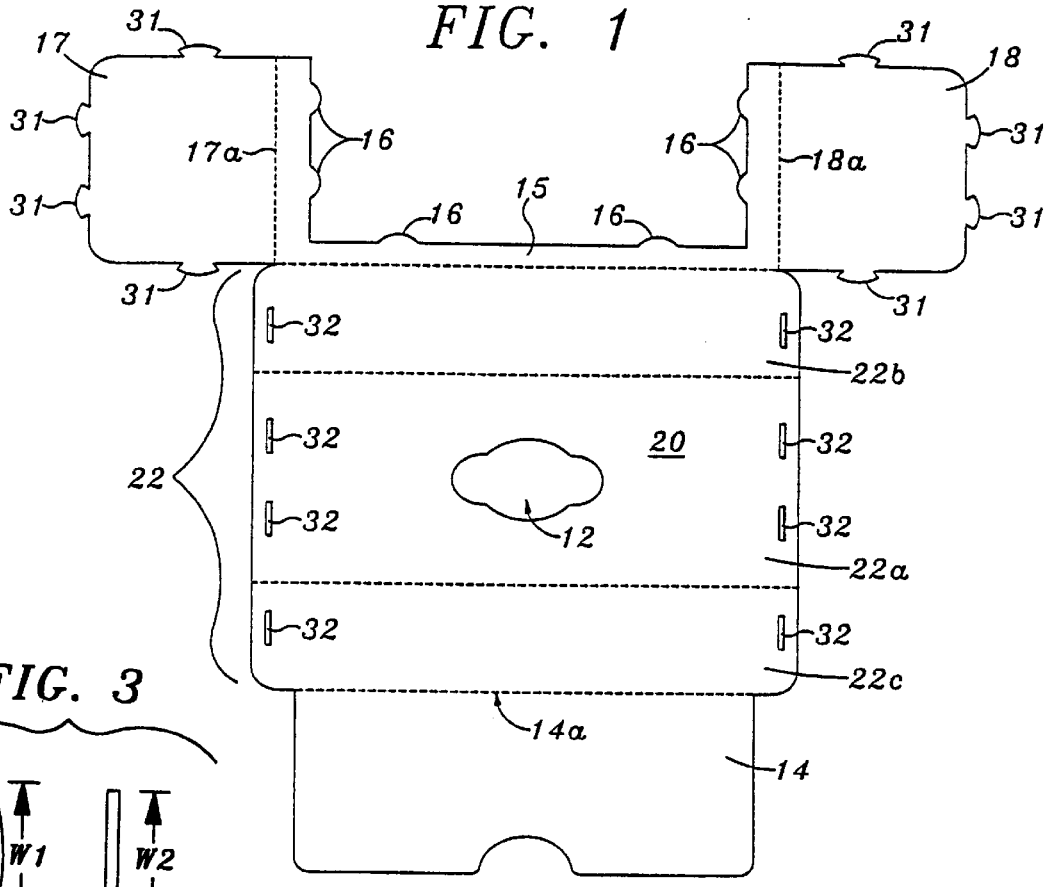
FIG. 1 is a plan view of the foldable panel member shown in its flat state.

The foldable body panel 20 is generally rectangular in shape as shown in FIG. 1 and comprises a one-piece resilient type material such as a thin sheet of resilient plastic, metal paperboard or other material including a thin wall or panel member made from recyclable materials. The member 20 includes a central portion 22 that defines the top side 22*a* and two opposite side walls 22*b*, 22*c* of the container 10 in its assembled state.

The door 14 is preferably in the form of a first wing member integrally and pivotally formed with the central portion 22 along a first fold line 14*a*. In its folded state, the door 14 interacts with a second wing member 15 integrally and pivotally formed with the central portion 22 along a second fold line 15*a* opposite from the first fold line 14*a* with respect to the central portion 22.

A pair of side flaps 17, 18 are integrally and pivotally formed with the second wing member 15 along a third and fourth fold lines 17*a*, 18*a* respectively.

The body panel 20 described above is sufficiently flexible or resilient to enable it to be easily formed into the shape shown in FIG. 2 as will be hereinafter explained.

Cooperatively engageable interlocking means are associated with side edge portions of the body panel 20 for enabling such side edge portions to be interlocked together to form the body of FIG. 2. The cooperatively engageable means include a plurality of notches or openings 32 disposed along an edge of central portion 22 and a plurality of sidewardly extending tabs or projections 31 disposed along an edge of the wing members 17, 18 (see FIG. 1). The tabs and notches 31 and 32 respectively are preferably integrally formed with the body panel 20 and are correspondingly shaped to permit easy locking engagement with each other by any non-skilled person without the use of tools and without utilizing external fastening means or any other components. In this regard, each notch 32 includes elongated portions 30 which correspond in length to the overall length of the corresponding tab member 31. This means that each respective tab member 31 can be positioned through the elongated portions of each respective notch 32 such that the entire tab member 31 is inserted therethrough. This construction ensures that each tab member 31 will be fully and completely inserted within its corresponding notch 32 as will be hereinafter further explained.

Figure 3:
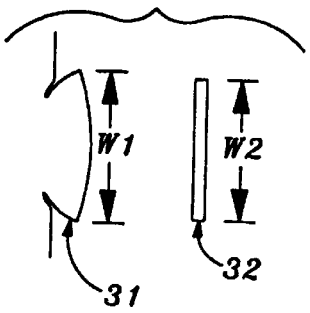
FIG. 3 is an enlarged partial perspective view of the cooperatively engageable interlocking means associated with the container assembly.

In the preferred embodiment of this invention, each tab member 31 is formed with a flared section 31*a* having a slightly larger width 'W1' than the notch 32 having width 'W2'. Thus, the flared section 31*a* provides a locking engagement with the notch as best shown in FIG. 3.

It should be understood that the flat body panel of this invention greatly facilitates transportation and easy assembly capability enhances portability from one location to another. It should also be recognized that various acceptable materials of construction are available and could equally be employed to fabricate the various components of the present invention. For example, the panel member could be made from any resilient type material as previously explained such as certain resilient, plastic materials, certain rubber-like materials, paper-board, certain metals and metal alloys as well as certain types of treated fabric materials so long as such materials are resilient or flexible enough to allow for sufficient bending of the panel members to achieve a resilient multi-sided form and such materials are of is sufficient rigidity to stand on end to form a container assembly. It is also recognized that a wide variety of cooperatively engageable joiner means other than the tab and notch arrangement illustrated in the accompanying drawings may be utilized to suitably fasten and attach the opposed side end portions of the various panel members into their closed wall form.

It is also important to note that the overall dimensions of the present container assemblies as well as the particular location and configuration of the various construction features associated therewith such as tab means 31, and the openings and slots 32, and panel sections 14, 15, 17, 18, and 22 are subject to wide variations; each may be sized and shaped into a wide variety of different sizes and configurations; and each may be incorporated into any of the present panel members in any combination thereof without impairing the teachings and practices of the present invention. The durability, flexibility and versatility of the present multipurpose container greatly increases its usefulness and effectiveness in a wide variety of applications both indoors and outdoors.

The present invention therefore provides a multi-purpose panel structure which can be used as a container and easily receives printing to promote goods and/or services, convey a message or present a unique design. The construction and operation of a container assembly can be packaged, stored and shipped in a substantially flat condition, and can be easily assembled without the use of tools or other fastener means for assembling the same.

The container assembly is constructed of a relatively lightweight resilient material which is sturdy and able to withstand normal usage. This container assembly is relatively simple and easy to manufacture, ship and assemble.

While there has been shown and described several embodiments of a novel multipurpose container adaptable for use both indoors and outdoors which multipurpose devices fulfill all of the objects and advantages sought therefor, many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

For example, the container 10 of this invention may be sized to receive an entire tissue box with tissue paper contained therein. In this embodiment, the container 10 is designed and sized to receive and conceal the pre-made tissue box.

What is claimed is:

1. A panel structure formed of a relatively thin resilient type material for use as a container device for holding and collecting material when in a folded state, said structure comprising:

a first wing member pivotally arranged with a central portion alone a first fold line, said first fold line defining a first lateral length;

said foldable central portion defining a first side edge and a second side edge, said first and second side edges being separated by a second lateral length parallel to and greater than said first lateral length;

a second wing member pivotally arranged with said central portion along a second fold line opposite from said first fold line with respect to said central portion, said second fold line defining a third lateral length greater than said first lateral length and smaller than said second lateral length;

a pair of side flaps pivotally arranged with said second wing member along third and fourth fold lines respectively, said pair of side flap each defining three exposed edges;

a plurality of tabs extending laterally from said three exposed edges of said pair of side flap for connecting said exposed edge of said pair of side flaps to said central portion;

a series of slots in said central portion aligned with and spaced from said first and second side edges, wherein each of said tabs are received in a respective one of said slots when said structure is in said folded state.

2. The panel structure of claim 1, wherein said third fold line is parallel to and offset from said upper edge of said central portion.

3. The panel structure of claim 1, wherein said fourth fold line is parallel to and offset from said lower edge of said central portion.

4. The panel structure of claim 1, wherein said first fold line is perpendicular to said upper and lower edges.

5. The panel structure of claim 1, wherein said second fold line is parallel to said first fold line.

6. The panel structure of claim 1, wherein said plurality of tabs each comprise a varying width to define a flared portion, said flared portion having a slightly greater width than a corresponding slot sized to receives each of said plurality of tabs.

7. The panel structure of claim 1, wherein said central portion defines three sides of a rectangular box in said folded state.

8. The panel structure of claim 1, wherein said first and second wing members cooperate in an interlocking manner to define a bottom side of a rectangular box in said folded state.

9. The panel structure of claim 1, wherein said pair of side flaps define substantially parallel and opposite sides of a rectangular box in said folded state.

10. The panel structure of claim 1, wherein said central portion comprises an aperture through which material to be retained in said panel structure in said folded state is passed.

11. The panel structure of claim 1, wherein said first and second wing members and said pair of flaps are integrally formed as a homogenous body with said central portion.

12. A container for use as a tissue holder formed of a relatively thin resilient type material, said container being formed from a single foldable panel member comprising:

a first wing member pivotally arranged with a foldable central portion along a first fold line, said first fold line defining a first length;

said foldable central portion defining three adjacent sides of said container, a first side edge and a second side edge, said first and second side edges being separated by a second length greater than said first length;

a second wing member pivotally arranged with said central portion along a second fold line, said second fold line defining a third length greater than said first lateral length and smaller than said second lateral length, said second wing member resiliently engaging said first wing member to define an entrance to an interior of said container;

a pair of side flaps pivotally arranged with said second wing member along third and fourth fold lines respectively, said pair of side flap each defining at least three exposed edges;

a plurality of tabs extending laterally from said at least three exposed edges of said pair of side flap for connecting said exposed edge of said pair of side flaps to said central portion;

a series of slots in said central portion aligned with and spaced from said first and second side edges, wherein each of said tabs are received in a respective one of said slots.

* * * * *